US009115725B2

(12) United States Patent
Haefliger et al.

(10) Patent No.: US 9,115,725 B2
(45) Date of Patent: Aug. 25, 2015

(54) CENTRIFUGAL PUMP AND METHOD FOR COMPENSATING THE AXIAL THRUST IN A CENTRIFUGAL PUMP

(75) Inventors: Mario Haefliger, Sarmenstorf (CH); Pascal Boesch, Zurich (CH)

(73) Assignee: LEVITRONIX GMBH, Zürich (CH)

( * ) Notice: Subject to any disclaimer, the term of this patent is extended or adjusted under 35 U.S.C. 154(b) by 351 days.

(21) Appl. No.: 12/820,925

(22) Filed: Jun. 22, 2010

(65) Prior Publication Data

US 2011/0002794 A1 Jan. 6, 2011

(30) Foreign Application Priority Data

Jul. 6, 2009 (EP) ..... 09164690

(51) Int. Cl.

| | |
|---|---|
| ***F04B 49/06*** | (2006.01) |
| ***F01D 1/02*** | (2006.01) |
| ***F04B 35/04*** | (2006.01) |
| ***F04D 29/22*** | (2006.01) |
| ***F04D 29/041*** | (2006.01) |
| ***F04D 29/048*** | (2006.01) |
| ***F04D 29/18*** | (2006.01) |
| ***F04D 13/06*** | (2006.01) |

(52) U.S. Cl.

CPC ..... *F04D 29/2266* (2013.01); *F04D 13/064* (2013.01); *F04D 13/0633* (2013.01); *F04D 29/048* (2013.01); *F04D 29/0413* (2013.01); *F04D 29/186* (2013.01)

(58) Field of Classification Search

CPC ..... F04D 7/02; F04D 29/22; F04D 29/2216; F04D 29/24

USPC ..... 417/420, 423.1, 423.15

See application file for complete search history.

(56) References Cited

U.S. PATENT DOCUMENTS

| | | | | |
|---|---|---|---|---|
| 3,107,310 | A * | 10/1963 | Carriere et al. | 310/103 |
| 3,123,010 | A * | 3/1964 | Witt et al. | 415/173.1 |
| 3,671,137 | A | 6/1972 | Ball | |
| 3,771,910 | A * | 11/1973 | Laing | 417/420 |
| 4,984,972 | A * | 1/1991 | Clausen et al. | 417/420 |
| 5,017,103 | A * | 5/1991 | Dahl | 417/420 |

(Continued)

FOREIGN PATENT DOCUMENTS

| | | |
|---|---|---|
| DE | 1 811 430 A1 | 6/1970 |
| DE | 23 44 576 A1 | 3/1975 |

(Continued)

*Primary Examiner* — Peter J Bertheaud
*Assistant Examiner* — Dominick L Plakkoottam
(74) *Attorney, Agent, or Firm* — Kilpatrick Townsend & Stockton LLP

(57) ABSTRACT

A centrifugal pump is proposed having a pump housing (2) which has an inlet (21) and an outlet (22), a rotor (3) having a front side (31) facing the inlet (21) and a rear side (32) remote from the inlet (21), and wherein the rotor (3) has a first pump wheel (4) having first vanes (41) for the generation of a main flow from the inlet (21) to the outlet (22), wherein a second pump wheel (5) having second vanes (52) and having at least one relief bore (6) is provided at the rotor (3) for the generation of a recirculation flow which is directed from the rear side (32) of the rotor (3) through the at least one relief bore (6) and wherein a partition element (7), which separates the recirculation flow at least partly from the main flow in the region of the second pump wheel (5), is provided between the two pump wheels (4, 5). A method for the compensation of the axial thrust in a centrifugal pump is furthermore proposed.

22 Claims, 8 Drawing Sheets

(56) References Cited

U.S. PATENT DOCUMENTS

Figure 1:
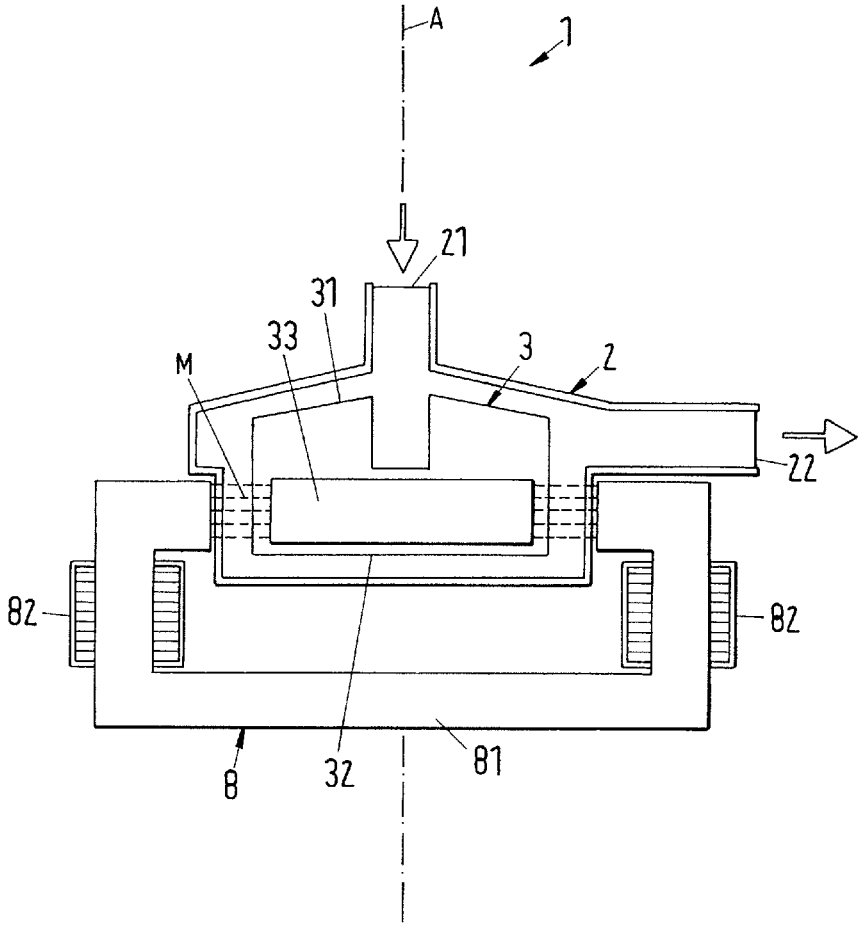

| | | | | |
|---|---|---|---|---|
| 5,360,317 | A * | 11/1994 | Clausen et al. | 415/206 |
| 5,399,074 | A * | 3/1995 | Nose et al. | 417/423.1 |
| 5,713,730 | A * | 2/1998 | Nose et al. | 417/423.12 |
| 5,863,179 | A * | 1/1999 | Westphal et al. | 415/206 |
| 6,129,507 | A | 10/2000 | Ganelin | |
| 6,171,078 | B1 * | 1/2001 | Schob | 417/423.1 |
| 6,623,475 | B1 * | 9/2003 | Siess | 604/891.1 |
| 7,156,802 | B2 * | 1/2007 | Woodard et al. | 600/16 |
| 7,682,301 | B2 * | 3/2010 | Wampler et al. | 600/16 |
| 2005/0095151 | A1 * | 5/2005 | Wampler et al. | 417/423.12 |

FOREIGN PATENT DOCUMENTS

| | | | |
|---|---|---|---|
| DE | 26 32 523 | A1 | 1/1978 |
| EP | 0 900 572 | A1 | 3/1999 |
| WO | WO 03/072947 | A1 | 9/2003 |

* cited by examiner

CENTRIFUGAL PUMP AND METHOD FOR COMPENSATING THE AXIAL THRUST IN A CENTRIFUGAL PUMP

CROSS REFERENCE TO RELATED APPLICATIONS

This application claims the priority of European Application No. 09 164 690.1, filed on Jul. 6, 2009, the disclosure of which is incorporated herein by reference.

The invention relates to a centrifugal pump and to a method for the compensation of the axial thrust in a centrifugal pump in accordance with the preamble of the independent claim of the respective category.

In centrifugal pumps in which the fluid to be conveyed is deflected from an axial direction into a radial direction, the pump wheel or the rotor undergoes high strains in the axial direction, by which the direction of the desired axis of rotation of the pump wheel is meant. This axial thrust is above all caused by the pressure difference at the rotor. Whereas essentially the suction pressure is present at the side of the rotor facing the inlet, a higher pressure is applied to the rear side of the rotor since the rear side of the rotor is in communication with the outlet, where essentially the conveying pressure is present. So that this axial thrust does not have to be taken up completely by the axial bearings, measures are known in centrifugal pumps to balance the rotor with respect to the axial direction.

A known measure is represented by relief bores which extend in the axial direction through the total pump wheel or through the total rotor and thus form flow communication between the front side and the rear side of the rotor, which results in a pressure relief of the rotor. It is also known to combine such relief bores with rudimentary blades provided at the rear side.

The axial balancing of the rotor by such measures is, however, difficult, if not even impossible, at least some working points. What is more, the forces required for the balancing are dependent on the working point, that is in particular on the flow and on the pressure difference which are generated by the pump.

The problem of the axial thrust compensation is particularly serious in pumps with a magnetically supported blade wheel, in particular when the axial support takes place magnetically completely without mechanical bearings. A centrifugal pump is known, for example, from EP-A-0 860 046 which is designed as a bearingless motor, with the rotor being stabilized in a passively magnetic manner with respect to the axial direction against displacements and tilting. To balance the rotor of such a bearingless motor, in addition to the magnetic reluctance force, only construction measures are available which influence the axial position via fluid dynamic compensation forces.

Measures known today for the axial balancing of the rotor for high pump performances or with more highly viscous fluids, such as photoresist or slurry, which can have viscosities of up to more than 100 centipoise, are in particular also frequently not sufficient with such centrifugal pumps which work in accordance with the principle of the bearingless motor.

Starting from this prior art, it is therefore an object of the invention to propose a centrifugal pump in which a balance of the axial thrust is reliably possible over a wide operating range. It is furthermore an object of the invention to propose a corresponding method for the balancing of the axial thrust in a centrifugal pump. This method should also in particular be usable for centrifugal pumps having a magnetically supported rotor.

The subject matters of the invention satisfying these objects are characterized by the features of the independent claims.

In accordance with the invention, a centrifugal pump is therefore proposed with a pump housing which has an inlet and an outlet, a rotor with a front side facing the inlet and a rear side remote from the inlet, wherein the rotor has a first pump wheel having first vanes for the generation of a main flow from the inlet to the outlet, and wherein a second pump wheel having two vanes and having at least one relief bore is provided at the rotor for the generation of a recirculation flow which is directed from the rear side of the rotor through the at least one relief bore, and wherein a partition element is provided between the two pump wheels which separates the recirculation flow at least partly from the main flow in the region of the second pump wheel.

A recirculation flow, which can be largely separated from the main flow, for the axial balancing or for the compensation of the axial thrust can be generated by the second pump wheel and the partition element. It is thus possible with the aid of the at least one relief bore to balance the rotor largely independently of the main flow with respect to the axial direction. A very large working range also for different viscosities and densities is possible using only one configuration of the rotor by means of an optimized geometry of the partition element and of the dimensions, in particular of the height of the first and second vanes relative to one another, and the number and the geometry of the relief bores.

The partition element is preferably made in disk form, with the first vanes of the first pump wheel being provided on the side facing the inlet and with the second vanes of the second pump wheel being provided on the side remote from the inlet.

An embodiment is in particular advantageous in which the first vanes are arranged such that a central region of the first pump wheel is free of vanes and wherein the partition element is designed so that it extends over the total central region of the first pump wheel. It is namely ensured by this construction that, on the one hand, the main flow and the recirculation flow do not have any contact with one another in this central region and, on the other hand, the partition element can advantageously contribute to the axial pressure relief as a dynamic pressure plate in a similar manner as is disclosed in the already cited EP-A-0 860 046 in connection with FIG. 8c for the impact plate designated by 1 k there.

It has proved to be advantageous in practice if the first and the second vanes extend beyond the partition element with respect to the radial direction.

It is particularly simple construction-wise if total vanes are provided which form both the first and the second vanes, wherein each total vane is separated by the partition element into two parts with respect to the axial direction in at least a radially inwardly disposed section.

Depending on the application case, an additional axial stabilization can be effected when rudimentary blades are provided on the rear side of the rotor.

It can be advantageous with respect to an ideal axial balancing if a plurality of relief bores are provided which are arranged symmetrically with respect to the axis of the rotor.

The rotor is magnetically supported in a particularly preferred embodiment.

Depending on the application case, embodiments are advantageous with an electric rotary drive for the rotor, with the rotary drive being designed as a canned motor.

An embodiment is specifically preferred having an electric rotary drive for the rotor, wherein the rotary drive has a stator, wherein the rotor forms the rotor of the electric rotary drive and forms, together with the stator, a bearingless motor in which the stator is designed as a bearing and drive stator for the rotor.

It is in particular advantageous in this respect if the rotor of the bearingless motor is permanently magnetic and is stabilized in a passive magnetic manner against displacements and tilting with respect to the axial direction.

A method is furthermore proposed by the invention for the compensation of the axial thrust in a centrifugal pump having a pump housing which has an inlet and an outlet, a rotor having a front side facing the inlet and a rear side remote from the inlet, in which method a main flow from the inlet to the outlet is generated using first vanes of a first pump wheel of the rotor, wherein a recirculation flow is generated using second vanes of a second pump wheel of the rotor, said recirculation flow being directed from the rear side of the rotor through at least one relief bore which is provided in the second pump wheel, wherein the recirculation flow is guided at least partly separately from the main flow in the region of the second pump wheel.

A recirculation flow, which can be largely separated from the main flow, for the axial balancing or for the compensation of the axial thrust can be generated using the method in accordance with the invention. It is thus possible with the aid of the at least one relief bore to balance the rotor largely independently of the main flow with respect to the axial direction. A compensation of the axial thrust in a very large working range is also possible for different viscosities and densities using only one configuration of the rotor with this method.

It has proved to be advantageous for some applications if the recirculation flow is guided substantially separately from the main flow.

The method in accordance with the invention is in particular suitable when the rotor is supported magnetically, preferably completely magnetically.

The method in accordance with the invention is specifically suitable for centrifugal pumps which work according to the principle of the bearingless motor, in which the centrifugal pump has an electric rotary drive with a stator, in which the rotor is permanently magnetic and forms the rotor of the electric rotary drive which, together with the stator, forms a bearingless motor, in which the stator is designed as a bearing and drive stator for the permanently magnetic rotor, wherein the rotor is stabilized in a passively magnetic manner against displacements and tilting with respect to the axial direction.

Further advantageous measures and embodiments of the invention result from the dependent claims.

Figure 2:
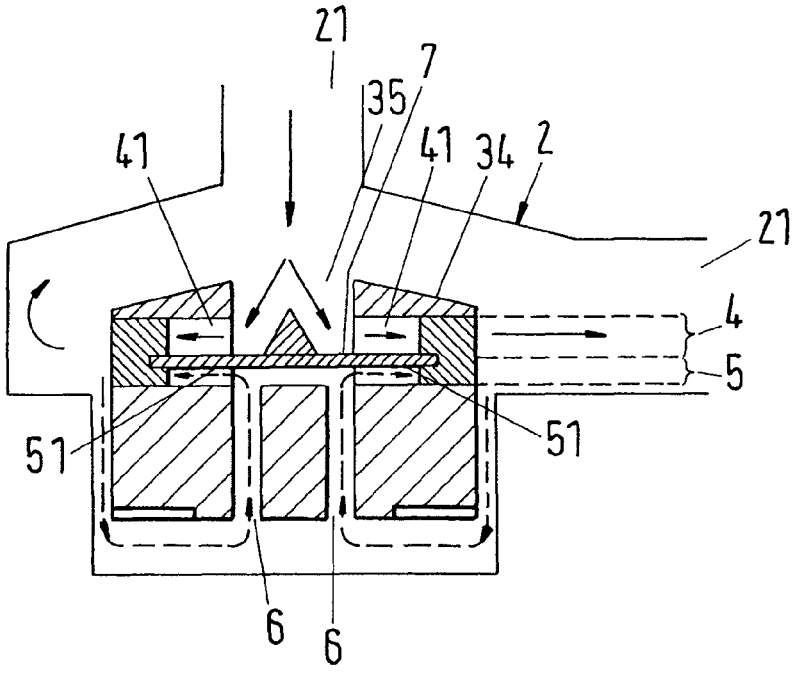
Figure 3:
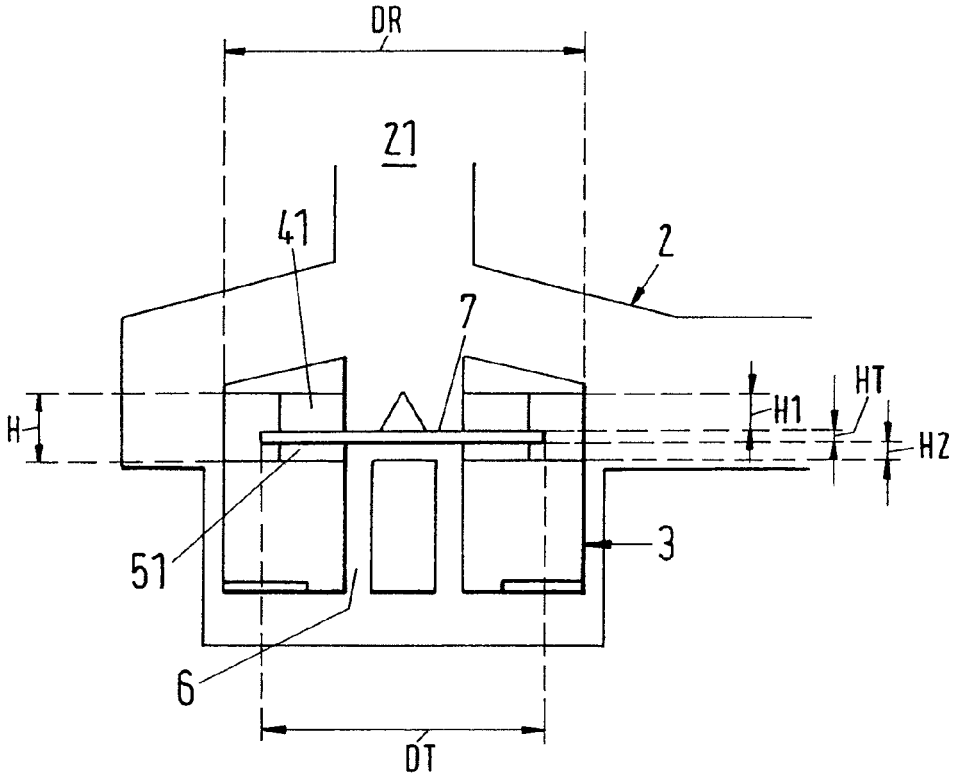
Figure 4:
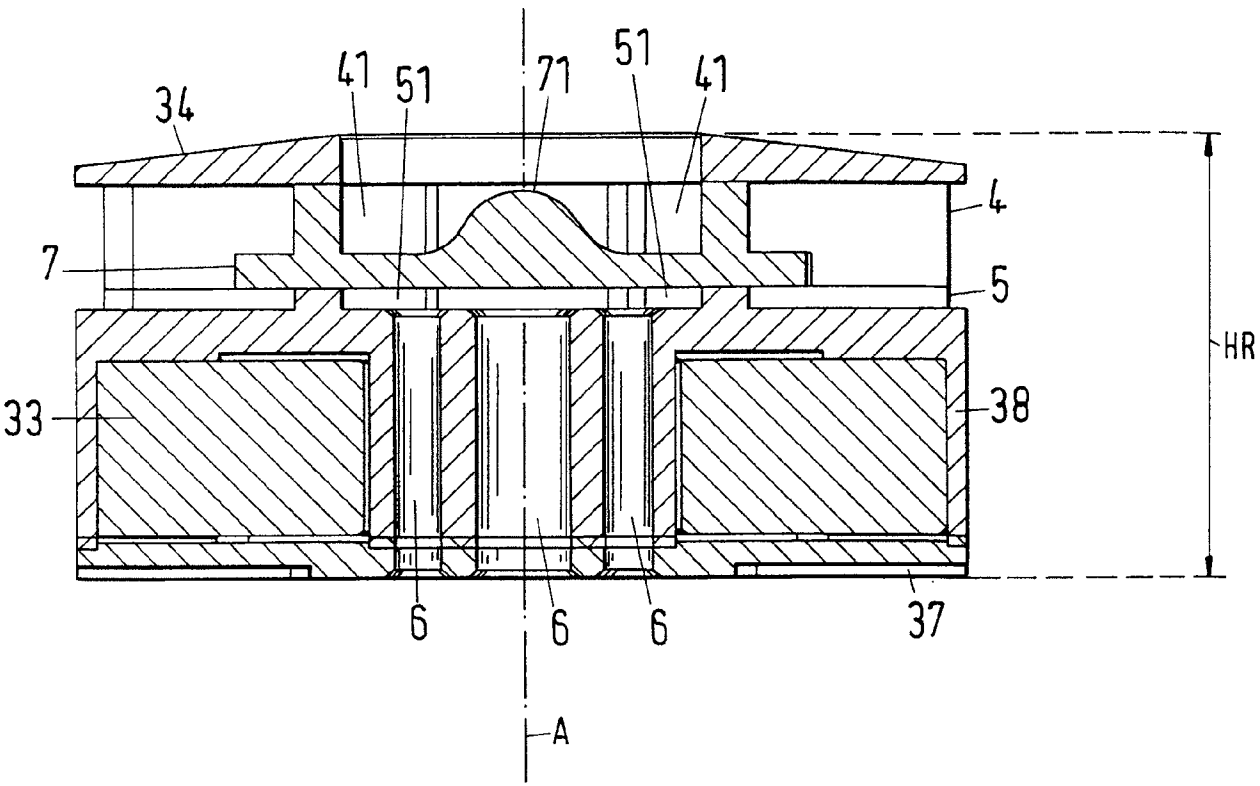
Figure 5:
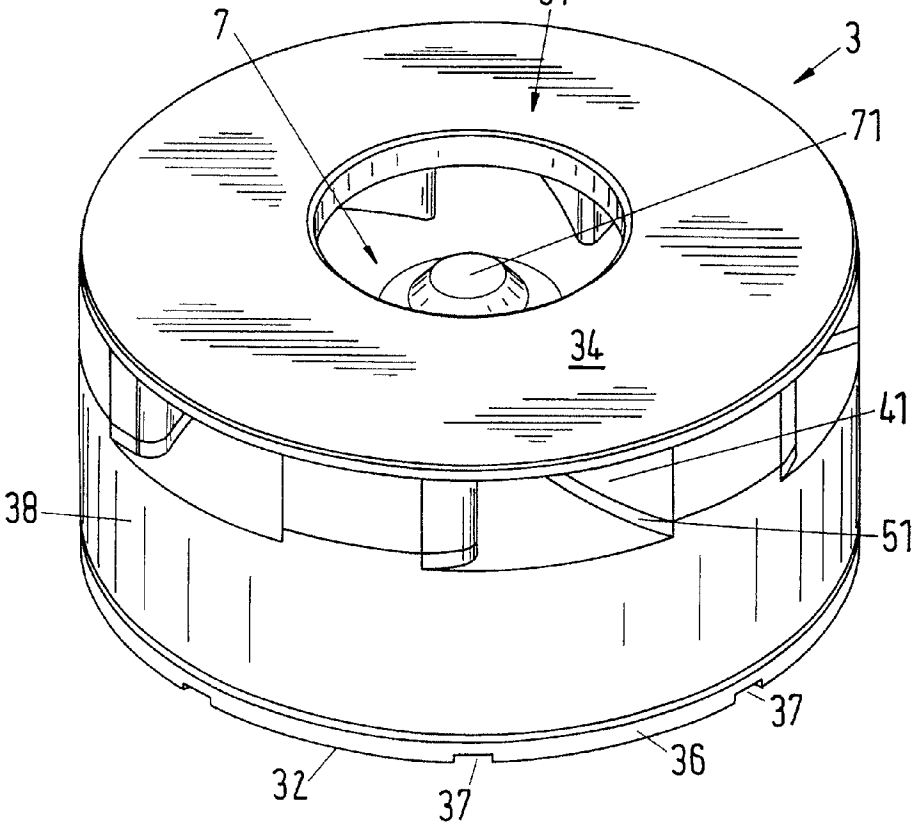
Figure 6:
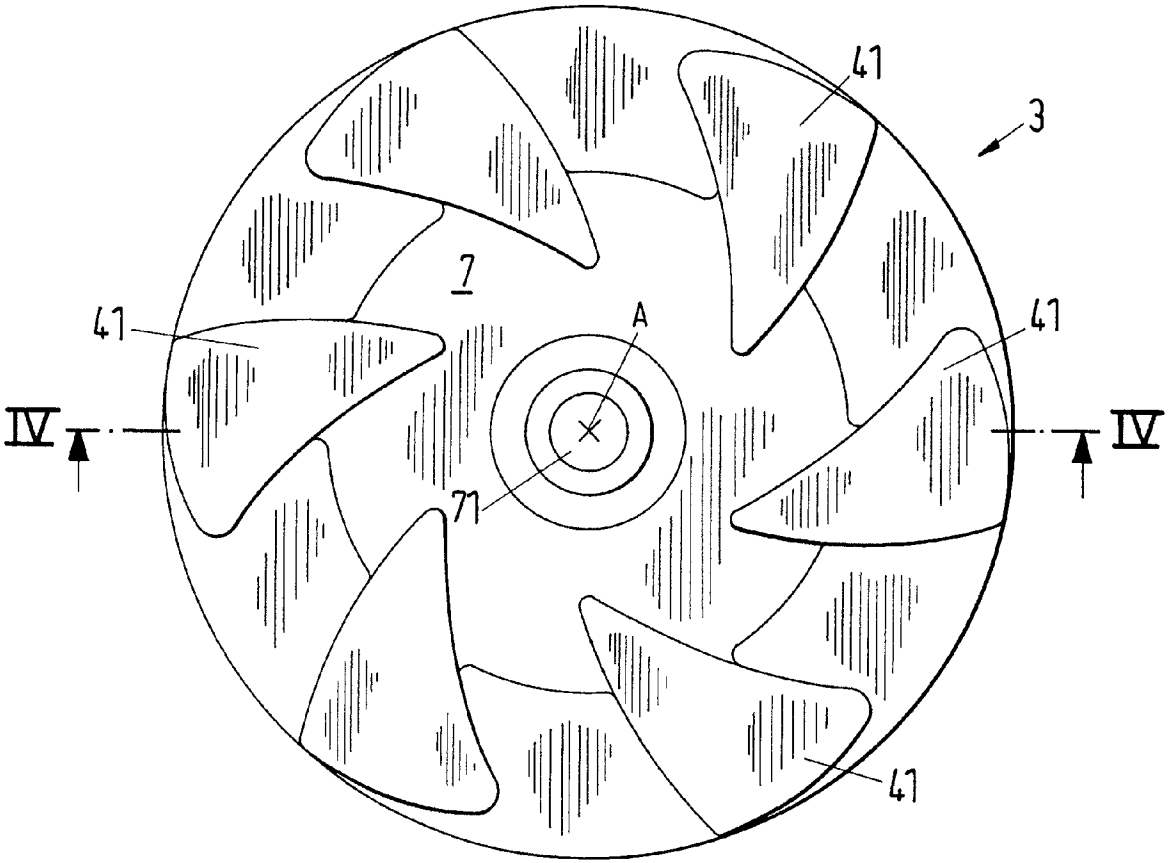
Figure 7:
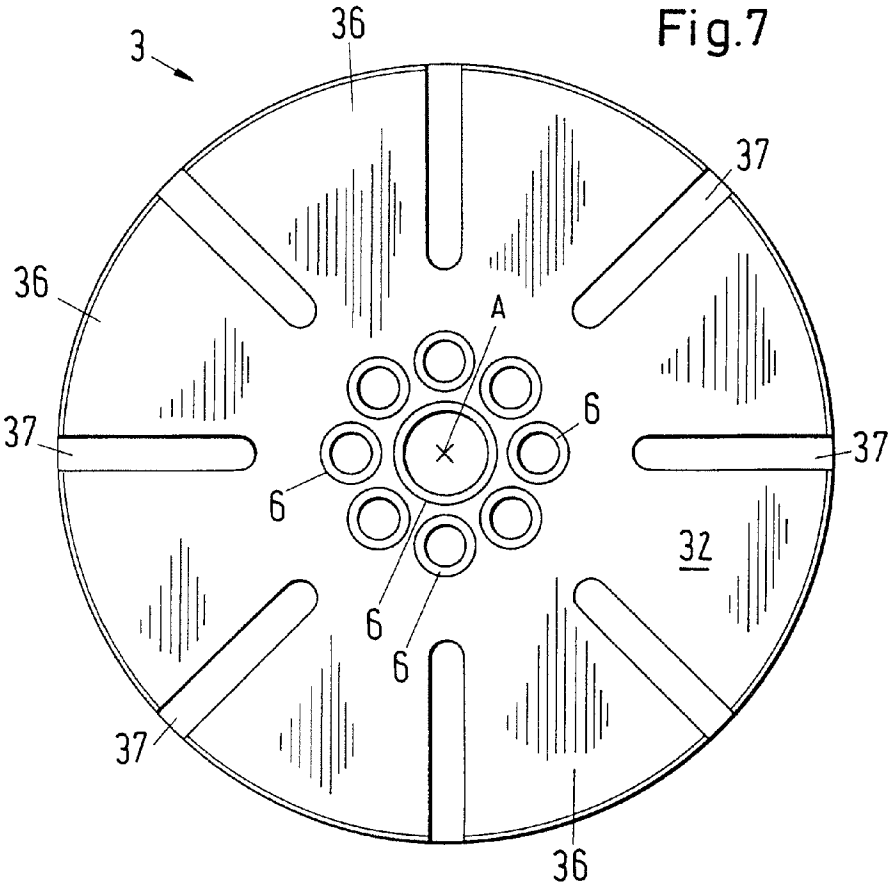

The invention will be explained in more detail in the following both in an apparatus respect and in a process engineering aspect with reference to embodiments and to the drawing. There are shown in the schematic drawing, partly in section:

FIG. 1: a very schematic representation of an embodiment of a centrifugal pump in accordance with the invention;

FIG. 2: a schematic sectional representation of the pump housing and of the rotor of the embodiment of FIG. 1, wherein the main flow and the recirculation flow are indicated;

FIG. 3: a schematic representation similar to FIG. 2 for the explanation of dimensions;

FIG. 4: a sectional representation through the rotor of the embodiment along the line IV-IV in FIG. 6;

FIG. 5: a view of the rotor from FIG. 4;

FIG. 6: a plan view of the front side of the rotor from FIG. 4, wherein the cover plate is removed;

FIG. 7: a plan view of the rear side of the rotor from FIG. 4; and

Figure 8:
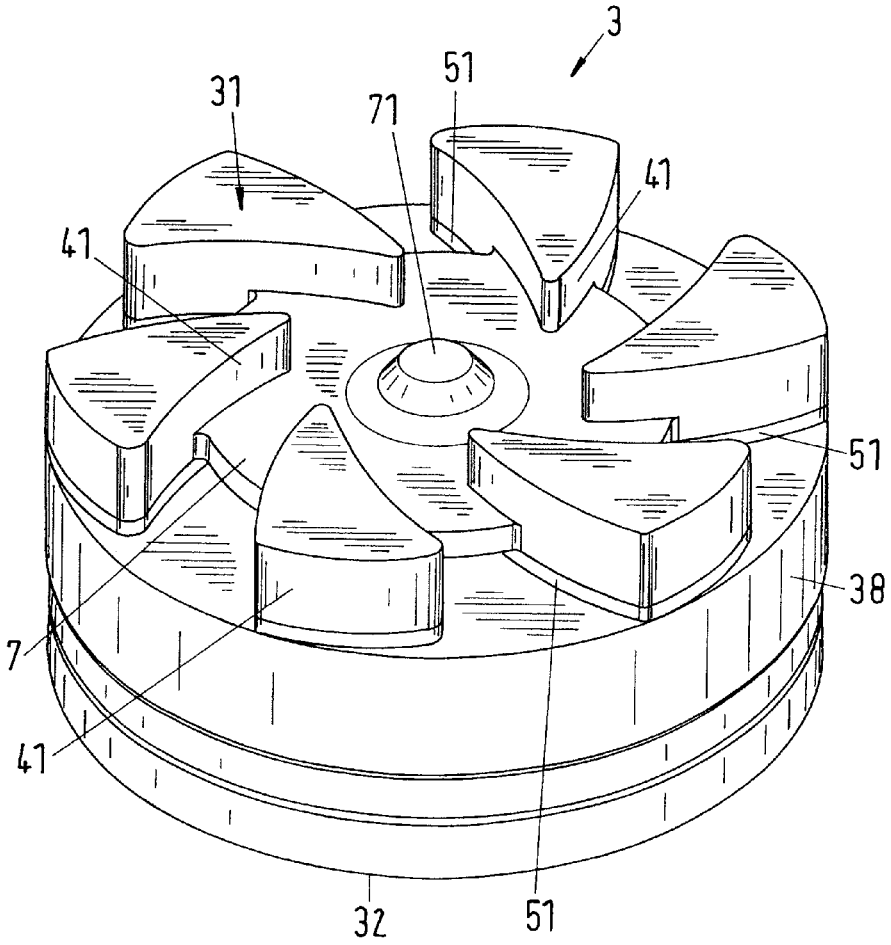

FIG. 8: a view of a variant of the rotor of FIG. 4, without cover plate.

FIG. 1 shows in a very schematic representation an embodiment of a centrifugal pump in accordance with the invention which is designated as a whole by the reference numeral 1.

In the following description of the invention, reference is made with an exemplary character to the case particularly important for practice that the centrifugal pump in accordance with the invention is designed with an electric rotary drive in accordance with the principle of a bearingless motor. It is, however, understood that the invention is not limited to such aspects, but rather relates very generally to centrifugal pumps. They can, in a non-exclusive list, be centrifugal pumps having a completely or partly magnetic support of the pump rotor, having a completely or partly mechanical and/or hydromechanical support or having a combined mechanical, magnetic and/or hydrodynamic support.

The embodiment of the centrifugal pump 1 in accordance with the invention shown in FIG. 1 includes a pump housing 2 having an inlet 21 and an outlet 22 for the fluid to be conveyed. A rotor 3 is provided in the pump housing having a front side 31 facing the inlet 21 and a rear side 32 remote from the inlet. As will be explained in more detail further below, the vanes provided for the pumping of the fluid are arranged at the rotor 3. The rotor axis, which means the axis of rotation A, about which the rotor 3 should rotated in the operating state, fixes the axial direction. With magnetically supported rotors, the axis of rotation A means the desired axis of rotation about which the rotor 3 rotates when it is centered and not tilted.

An electric rotary drive 8 which includes a stator 81 with windings 82 is provided for the driving of the rotor 3.

The rotor 3 in the pump housing 2 is simultaneously also the rotor 3 of the electric rotary drive 8. This embodiment is also called an integral rotor because the rotor of the electric rotary drive is identical to the pump rotor which conveys the fluid.

As already mentioned, the rotary drive 8 in this preferred embodiment is made as a bearingless motor in which the stator 81 is designed as a bearing and drive stator for the magnetic support of the rotor 3 and for the drive of the rotation of the rotor 3 about the axis of rotation A. The rotor 3 is particularly preferably designed as a permanently magnetic rotor 3 which, together with the stator 81, forms a bearingless motor in which the stator is designed as a bearing and drive stator for the permanently magnetic rotor 3. The magnetic support of the rotor 3 is indicated by means of the field lines M in FIG. 1.

Such a bearingless motor is disclosed, for example, in the already cited EP-A-0 860 046 and also in EP-A-0 819 330. The term bearingless motor means that the rotor 3 is supported completely magnetically, with no separate magnetic bearings being provided. The stator 81 is designed for this purpose as a bearing and drive stator; it is therefore both the stator of the electric drive and the stator of the magnetic support. For this purpose, the winding 82 of the stator 81 includes a drive winding with the pole pair number p as well as a control winding pole pair number p±1. A rotating magnetic field can be produced using these two windings which, on the one hand, exerts a torque onto the rotor 3 which effects its rotation and which, on the other hand, exerts a shear force, which can be set as desired, onto the rotor 3 so that the rotor's radial position can be controlled or regulated actively. Three degrees of freedom of the rotor 3 can thus be actively regulated. The rotor is passively magnetically, that is not controllably, stabilized by reluctance forces with respect to three further degrees of freedom, namely its axial deflection in the direction of the axis of rotation A and tilts with respect to the plane perpendicular to the axis of rotation A (two degrees of freedom). Reference is made to the already cited documents with respect to further details of such a bearingless motor.

Specifically, the rotary drive 8 shown in FIG. 1 is designed as a canned motor, wherein the pump housing 2 forms the can between the stator 81 and the rotor 3.

FIGS. 2 and 3 show, in a schematic sectional representation, the pump housing 2 and the rotor 3 of the embodiment of FIG. 1, wherein FIG. 2 serves for the illustration of the basic function and of the flow courses in the pump housing 2, whereas FIG. 3 illustrates the fixing of some geometrical parameters.

For better understanding, a detailed representation of the rotor 3 is shown in FIGS. 4-7, wherein FIG. 4 shows a section through the rotor 3 along the line IV-IV in FIG. 6; FIG. 5 a perspective view of the rotor 3; FIG. 6 a plan view of the front side 31 of the rotor 3 (without cover plate); and FIG. 7 a plan view of the rear side 32 of the rotor 3.

FIG. 8 shows a perspective view similar to FIG. 5 (but without a cover plate) for a variant of the rotor 3. In this variant, no cover plate is provided at the front side of the rotor 3. Otherwise the differences relate to the rear side 32 of the rotor 3, that is the remainder of the rotor 3 and in particular the pump wheels are identical to the rotor shown in FIGS. 4-7.

As FIG. 2 shows, the rotor 3 has a first pump wheel 4 having first vanes 41 at its side facing the inlet 21. The first pump wheel 41 generates in a manner known per se a main flow with which the fluid to be conveyed which comes from the axial direction through the inlet 21 is conveyed to the outlet 22. This main flow is illustrated in FIG. 2 by means of the solid arrows.

In accordance with the invention, a second pump wheel 5 having two vanes 51 is provided at the rotor 3 and has at least one relief bore 6. This second pump wheel 3 generates a recirculation flow which is directed from the rear side 32 of the rotor 3 through the relief bore 6. The recirculation flow is illustrated in FIG. 2 by means of the arrows shown dashed. It is essential for the invention that a partition element 7 which separates the recirculation flow at least partly from the main flow in the region of the second pump wheel 5 is provided between the first pump wheel 4 and the second pump wheel 5.

As in particular FIG. 2 shows, the relief bores 6 extend from the rear side 32 of the rotor 3 up to or through the second pump wheel 5, but not through the first pump wheel 4, so that a direct contact of the recirculation flow with the main flow is avoided at the second pump wheel 5 in the region of the output of the relief bores 6.

The recirculation flow required for the axial balancing or for the compensation of the axial thrust can be largely separated from the main flow by the partition element 7. The rotor can thereby be largely balanced independently of the main flow with respect to the axial thrust. A very large working range, that is a large range of different throughflows and of different conveying pressures, can thus also be realized for different viscosities and densities of the fluid to be conveyed using only one configuration of the rotor 3, without concessions being necessary with respect to the quality of the axial balancing. It is in particular also avoided by the partition element 7 that the recirculation flow and the main flow impact one another frontally—that is from oppositely directed flows, which would result in vortices which are disadvantageous for the balancing.

The main flow and the recirculation flow only come into contact with one another after passing the radial outer end of the partition element 7. Both flows are here essentially directed in the radial direction so that a frontal mutual impacting of the main flow and the recirculation flow is also avoided here.

In the embodiment described here, the partition element 7 is made in disk form (see also FIG. 4 and FIG. 8), wherein the first vanes 41 of the first pump wheel 4 are provided at the side facing the inlet 21 and the second vanes 51 of the second pump wheel 5 are provided on the side remote from the inlet. The first vanes 41 are arranged such that a central region 35 of the first pump wheel 4 is free of vanes 41. The disk-shaped partition element 7 extends at least over the total central region 35 with respect to the radial direction so that no direct flow communication exists between the first pump wheel 4 and the second pump wheel 5 in this central region 35. The partition element 7 consequently screens the second pump wheel 5 at least in the central region 35 with respect to the inlet 21.

In its central region, the partition element 7 has a round elevated portion 71 which serves for the better deflection of the fluid in the radial direction.

Both the second vanes 51 of the second pump wheel 5 and the first vanes 41 of the first pump wheel 4 each extend in a curved manner in the radial direction. A direction perpendicular to the axial direction is meant by radial direction in this respect. As in particular FIG. 8 also shows, the vanes 41 of the first pump wheel 4 coincide with the vanes 51 of the second pump wheel 5. This is admittedly advantageous, but not necessary. The first vanes 41 and the second vanes 51 can also be offset with respect to one another with respect to the peripheral direction. The number of the first vanes 41 can furthermore differ from the number of the second vanes 51. In the embodiment described here, the number of the first vanes 41 is equal to the number of the second vanes 51.

A cover plate 34 is provided at the front side 31 of the rotor 3 (see also FIG. 4 and FIG. 5) which is designed in ring-disk shape. The cover plate 34 extends in the radial direction up to the radially outer end of the first vanes 41. It has in the center a central circular opening whose diameter is of equal size to the diameter of the central region 35. The thickness of the cover plate 34 reduces outwardly. The first vanes 41 are thus completely covered by the cover plate 34 so that only the central region 35 of the pump wheel 4 is in direct flow communication with the inlet 21 with respect to the axial direction. The cover plate 34 serves for the flow guidance and makes provision that the fluid flowing through the inlet 21 can only reach the first pump wheel 4 through the central region 35.

It has proved advantageous in practice for some applications when the first vanes 41 and the second vanes 51 extend beyond the partition element 7 with respect to the axial direction. This measure best becomes visible in the representation of FIG. 2, FIG. 4, FIG. 6 and FIG. 8. It can clearly be recognized that the partition element 7 only extends over the radial inner region of the first vanes 41 and of the second vanes 51. In the radial outer region of the first vanes 41 and of the second vanes 51, a partition element is no longer present between them.

How far the partition element 7 extends between the first vanes 41 and the second vanes 51 with respect to the radial direction depends on the application case and is one of the parameters which are available for the optimization of the axial thrust compensation. In the embodiment described here with the disk-shaped partition element 7, the partition element 7 should extend at least so far with respect to the radial direction that it covers the total central region 35. On the other hand, the partition element 7 can also extend over the total radial extent of the vanes 41 or 51 so that the partition element 7 terminates flush with the vanes 41 or 51 in the radial direction. These geometrical relationships will be looked at further below.

A particularly favorable measure construction-wise is (see FIG. 6 and FIG. 8) when the first vanes 41 and the second vanes 51 form total vanes. Or, expressed conversely, total vanes are provided which form both the first vanes 41 and the second vanes 51. In this respect, each total vane is separated into two parts by the partition element in its radially inwardly disposed section with respect to the axial direction so that the upper part in accordance with the illustration in FIG. 8, which is disposed above the partition element 7, forms the first vanes 41 of the first pump wheel 4 and the lower part, which is disposed beneath the partition element 7, forms the second vanes 51 of the second pump wheel 5.

A further measure which can be advantageous is to provide rudimentary blades 36 on the rear side 32 of the rotor 3. FIG. 7 shows a plan view of the rear side 32 of the rotor 3 remote form the inlet 21. A plurality of grooves 37, eight here, are provided there which each extend radially outwardly up to the margin of the rotor 3. The grooves 37 extend inwardly, but not up to the center of the rear side 32 of the rotor 3, but rather end in a middle region, as is also shown in FIG. 2. The radially outer regions between a respective two adjacent grooves 37 then form the rudimentary blades 36. They can effect an additional axial stabilization of the rotor 3.

To achieve a compensation of the axial thrust which is as good as possible, it can be advantageous to provide a plurality of relief bores 6 which are in particular arranged symmetrically with respect to the axis of rotation of the rotor 3. As FIG. 7 shows, in the embodiment described here, a central relief bore 6 is provided at the center of the rear side 32 of the rotor 3 and eight further relief bores 6 which are arranged in circular shape and equidistantly around the central relief bore 6.

FIG. 8 shows a view of a variant of the rotor of FIG. 4, wherein no cover plate 34 is provided in this variant. There is furthermore a difference from the embodiment in FIG. 4 in that in the variant shown in FIG. 8 no grooves 37 are provided on the rear side 32 of the rotor 3 and thus also no rudimentary blades 36 are provided. The dispensing with of the cover plate and of the rudimentary blades can in each case be realized as an individual measure or also in combination with one another.

Since the embodiment of the centrifugal pump described here is designed as a bearingless motor with a permanently magnetic rotor 3, the rotor 3 includes a ring-shaped permanent magnet 33 which is arranged beneath the two pump wheels 4, 5 in accordance with the representation in FIG. 4. The permanent magnet 33 is located in a jacket 38 which is preferably manufactured from plastic, metal or ceramic material. As the illustration in FIG. 1 indicates, the permanent magnet 33 cooperates with the stator 81 of the electric rotary drive 8 and serves both for the magnetic support and for the drive of the rotor 3.

It is particularly simple and compact construction-wise if the second vanes 51 of the second pump wheel 5 are in one piece with the jacket 38, as FIG. 4 and FIG. 5 show. The two vanes 51 can thus be worked out of the surface of the jacket 38 by a material-removing machining step, e.g. by milling.

There are different parameters with which the configuration of the rotor can be optimized in order to realize the compensation of the axial thrust as efficiently as possible and for a working range which is as large as possible, that is in particular for a large throughflow range and for a large pressure range—also with different viscosities and densities—with the method in accordance with the invention and/or with the centrifugal pump in accordance with the invention.

Some geometrical dimensions are defined for this purpose in FIG. 3 for the described embodiment: DR designates the outer diameter of the rotor 3 which is usually identical to the outer diameter of the first and/or of the second pump wheel 4 and 5 respectively; DT designates the outer diameter of the disk-shaped partition element 7; H designates the height of the partition element 7; and H1 and H2 the height of the first vanes 41 and of the second vanes 51 respectively. The height in each case means the extent in the axial direction.

An important parameter is the ratio of DT and DR. It has previously proven itself in practice if the ratio DT/DR is larger than 0.5 and smaller than or equal to 1; the range from 0.6 to 0.7 is in particular preferred. It is preferred with respect to the height of the vanes 41, 51 and of the partition element 7 between the vanes 41, 51 if the height H2 of the second vanes 52 is smaller than the height HT of the partition element 7 and if HT is smaller than the height H1 of the first vanes. With respect to the height H of the total vanes, the height H2 of the second vanes 52 is preferably smaller than half of H, in particular at most 25% of H, and specifically between 15% and 20% of H. The height H1 of the first vanes 41 is preferably larger than half of H, in particular at most 75% of H, and specifically between 50% and 60% of H.

In the preferred embodiment of the centrifugal pump in accordance with the invention as a bearingless motor with a permanently magnetic rotor 3, it is advantageous with respect to the magnetic support, in particular with respect to the passively magnetic stabilization with regard to the axial direction, if the ratio of the total height HR of the rotor 3 (see FIG. 4) and the outer diameter DR of the rotor is at most 1, that is HR/DR≤1, preferably HR/HD is smaller than 0.9, and specifically between 0.7 and 0.8.

Such embodiments of the centrifugal pump in accordance with the invention are also possible in which the pump housing 2 has more than one outlet 22 and/or more than one inlet 21. If two or more inlets 21 are provided, they are to be arranged on the same side of the rotor 3 or of the first pump wheel 4, that is it must be avoided that the fluid can move directly from one of the inlets from the axial direction to the second pump wheel.

The invention claimed is:

1. A centrifugal pump, comprising:

a pump housing comprising an inlet and an outlet;

a rotor having a front side facing the inlet and a rear side remote from the inlet, wherein the rotor further comprises:

a first pump wheel comprising first vanes configured to generate a main flow from the inlet to the outlet, further comprising a first axis, and a second pump wheel comprising second vanes and at least one relief bore, wherein the second vanes and the relief bore are configured to generate a recirculation flow which is directed from the rear side of the rotor through the relief bore, the second pump wheel further comprising a second axis; and a partition element, disposed between the first pump wheel and the second pump wheel, wherein the partition element defines a barrier, extending in a plane transverse to the first axis and the second axis, between the first pump wheel and the second pump wheel, to thereby separate the recirculation flow at least partly from the main flow.

2. The centrifugal pump in accordance with claim 1, wherein the partition element is disk shaped, wherein the first vanes are disposed on the front side of the rotor and the second vanes are disposed on the rear side of the rotor.

3. The centrifugal pump in accordance with claim 1, wherein a central region of the first pump wheel is free of vanes; and wherein the partition element extends over the total central region of the first pump wheel.

4. The centrifugal pump in accordance with claim 1, wherein the first vanes and the second vanes extend beyond the partition element with respect to the radial directions of the respective pump wheels.

5. The centrifugal pump in accordance with claim 1, wherein each first vane and each second vane is separated by the partition element into two parts with respect to the axial direction in at least a radially inwardly disposed section.

6. The centrifugal pump in accordance with claim 1, further comprising blades at the rear side of the rotor.

7. The centrifugal pump in accordance with claim 1, wherein the at least one relief bore is a plurality of relief bores disposed symmetrically with respect to the second axis.

8. The centrifugal pump in accordance with claim 1, wherein the rotor is magnetically supported within the housing.

9. The centrifugal pump in accordance with claim 1, further comprising an electric rotary drive for the rotor, wherein the rotory drive is a canned motor.

10. The centrifugal pump in accordance with claim 1, further comprising a stator, wherein the rotor cooperates with the stator to thereby define an electric rotary drive and a bearingless motor, wherein the stator is a bearing and drive stator for the rotor.

11. The centrifugal pump in accordance with claim 10, wherein the rotor is permanently magnetic and is stabilized in a passively magnetic manner with respect to an axial direction of the first axis and the second axis against displacements and tilting.

12. A method for compensation of axial thrust in a centrifugal pump, the pump comprising a pump housing, the pump housing comprising an inlet and an outlet; the pump further comprising a rotor having a front side facing the inlet and a rear side remote from the inlet, wherein the rotor further comprises a first pump wheel comprising first vanes and a first axis; wherein the rotor further comprises a second pump wheel comprising second vanes, at least one relief bore, and a second axis; the pump further comprising a partition element, wherein the partition element is disposed between the first pump wheel and the second pump wheel, and wherein the partition element defines a barrier, extending in a plane transverse to the first axis and the second axis, between the first pump wheel and the second pump wheel, the method comprising:

generating a main flow from the inlet to the outlet by the first vanes;

generating a recirculation flow by the second vanes, said recirculation flow being directed from the rear side of the rotor through the relief bore; and separating the recirculation flow at least partly from the main flow by the barrier defined by the partition element.

13. The method in accordance with claim 12, wherein separating the recirculation flow at least partly from the main flow comprises substantially separating the recirculation flow from the main flow.

14. The method in accordance with claim 12, further comprising magnetically supporting the rotor within the housing.

15. The method in accordance with claim 12, wherein the centrifugal pump further comprises a stator, wherein the rotor is permanently magnetic and cooperates with the stator to thereby define an electric rotary drive and a bearingless motor, wherein the stator is a bearing and drive stator for the permanently magnetic rotor, and wherein the rotor is stabilized in a passively magnetic manner with respect to the axial direction against displacements and tilting.

16. The method in accordance with claim 14, wherein the rotor is supported completely magnetically.

17. The centrifugal pump in accordance with claim 1, wherein the at least one relief bore does not penetrate the partition element.

18. The centrifugal pump in accordance with claim 1, wherein the partition element substantially blocks direct fluid communication between the second pump wheel and the inlet.

19. The centrifugal pump in accordance with claim 18, wherein the partition element is substantially planar.

20. The method in accordance with claim 12, wherein the at least one relief bore does not penetrate the partition element.

21. The method in accordance with claim 12, wherein the partition element substantially blocks direct fluid communication between the second pump wheel and the inlet.

22. The method in accordance with claim 21, wherein the partition element is substantially planar.

* * * * *